US006037114A

United States Patent [19]

Hoogmartens et al.

[11] Patent Number: 6,037,114

[45] Date of Patent: Mar. 14, 2000

[54] THERMOGRAPHIC RECORDING MATERIAL WITH IMPROVED IMAGE DENSITY AND/OR IMAGE GRADATION UPON THERMAL DEVELOPMENT

[75] Inventors: Ivan Hoogmartens, Wilrijk; Ingrid Geuens, Emblem; Johan Loccufier, Zwijnaarde, all of Belgium

[73] Assignee: Agfa-Gevaert, Mortsel, Belgium

[21] Appl. No.: 09/199,924

[22] Filed: Nov. 25, 1998

Related U.S. Application Data

[60] Provisional application No. 60/072,675, Jan. 27, 1998.

[51] Int. Cl.[7] ..... G03C 1/498

[52] U.S. Cl. ..... 430/617; 430/203; 430/600; 430/601; 430/610; 430/619

[58] Field of Search ..... 430/610, 601, 430/600, 617, 619, 203

[56] References Cited

U.S. PATENT DOCUMENTS

| | | | |
|---|---|---|---|
| 5,395,747 | 3/1995 | Helland et al. | 430/510 |
| 5,656,419 | 8/1997 | Toya et al. | 430/619 |
| 5,714,311 | 2/1998 | Cowdery-Corvan et al. | 430/607 |

FOREIGN PATENT DOCUMENTS 0838722 4/1998 European Pat. Off. .

*Primary Examiner*—Thorl Chea
*Attorney, Agent, or Firm*—Baker & Botts, L.L.P.

[57] ABSTRACT

A recording material exclusive of a thermal bleachable dye comprising a support and a thermosensitive element comprising an organic silver salt, an organic reducing agent therefor in thermal working relationship therewith and a binder, wherein the recording material further contains non-halide-ion-containing arylonium compound exclusive of compounds according to formula (I):

(I)

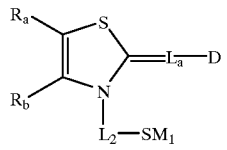

wherein $L_a$ is a valence bond or a divalent or trivalent linking group, $L_2$ is an alkylene group, each of $R_a$ and $R_b$ is a hydrogen atom or monovalent substituent group, $M_1$ is an onium ion, $R_a$ and $R_b$ may form a ring taken together and D is an electron donative group of atoms, with the proviso that where D is a hydrazino group which is not a part of a semicarbazido group, no oxo group is substituted to the carbon atom which is directly attached to a nitrogen atom of the hydrazine; and a recording process therefor.

12 Claims, No Drawings

THERMOGRAPHIC RECORDING MATERIAL WITH IMPROVED IMAGE DENSITY AND/OR IMAGE GRADATION UPON THERMAL DEVELOPMENT

The application claims benefit of Provisional application Ser. No. 60/072,675 filed Jan. 27, 1998.

DESCRIPTION

1. Field of the Invention

The present invention relates to a thermographic recording material suitable for thermal development. In particular, it concerns improvements in the maximum image density and/or image gradation of the thermographic prints therewith.

2. Background of the Invention

Thermal imaging or thermography is a recording process wherein images are generated by the use of thermal energy.

In direct thermal thermography a visible image pattern is formed by image-wise heating of a recording material containing matter that by chemical or physical process changes colour or optical density. Such recording materials become photothermographic upon incorporating a photosensitive agent which after exposure to UV, visible or IR light is capable of catalyzing or participating in a thermographic process bringing about changes in colour or optical density.

Most of the "direct" thermographic recording materials are of the chemical type. On heating to a certain conversion temperature, an irreversible chemical reaction takes place and a coloured image is produced.

According to U.S. Pat. No. 3,080,254 a typical heat-sensitive (thermographic) copy paper includes in the heat-sensitive layer a thermoplastic binder, a water-insoluble silver salt and an appropriate organic reducing agent. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

U.S. Pat. No. 5,395,747 discloses a thermal-dye-bleach layer comprising: (a) a thermal bleachable dye in association with a thermally-generated-bleaching agent; and (b) at least one stabilizing compound selected from the group of five compound types. The precursors for the thermally-generated-bleaching agent may be onium ions.

EP-A 838 722 disclose a photothermogrphic material comprising (a) a reducible silver source, (b) a photocatalyst, (c) a reducing agent, (d) a binder, and (e) at least one compound of the general formula: X-$L_1$-D wherein D is an electron donative group of atoms, with the proviso that where D is a hydrazino group which is not a part of a semicarbazide group, no oxo group is substituted to the carbon atom which is directly attached to a nitrogen atom of the hydrazine, X is a group capable of promoting adsorption to silver halide, and $L_1$ is a valence bond or a linking group. In a specific embodiment of X-$L_1$-D may be a compound with the general formula (I):

(I)

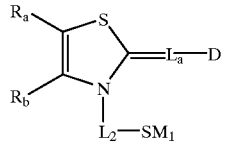

wherein $L_a$ is a valence bond or a divalent or trivalent linking group, $L_2$ is an alkylene group, each $R_a$ and $R_b$ is a hydrogen atom or monovalent substituent group, $M_1$ is an onium ion, $R_a$ and $R_b$ may form a ring taken together and D is an election donative group of atoms, with the proviso that where D is a hydrazino group which is not a part of a semicarbazido group, no oxo group is substituted to the carbon atom which is directly attached to a nitrogen atom of the hydrazine.

It is desirable that prints made with thermographic recording materials on the basis of substantially light-insensitive organic silver salts and reducing agents exhibit a neutral image tone, but the experience of the inventors is that achievement of a neutral image tone is associated with an undesirable decrease in the achievable maximum image density and a decrease in the gradation of the image, the gradation of an image being the dependence of the optical density of an image upon applied thermal energy in the case of substantially light-insensitive thermographic recording materials and the dependence of optical density of an image upon exposure in the case of photothermographic materials.

OBJECTS OF THE INVENTION

It is therefore an object of the invention to provide a thermographic recording material, which on imagewise thermal development produces a neutral image with a higher maximum image density and/or a higher image gradation.

Further objects and advantages of the invention will become apparent from the description hereinafter.

SUMMARY OF THE INVENTION

Surprisingly it has been found that thermographic recording materials comprising a support and a thermosensitive element comprising an organic silver salt and a reducing agent exhibiting a neutral image tone exhibit an increase in maximum image density and an increase in image gradation upon incorporating a non-halide-ion-containing polyarylonium compound.

The above mentioned object is realised with a recording material exclusive of a thermal bleachable dye comprising a support and a thermosensitive element comprising an organic silver salt, an organic reducing agent therefor in thermal working relationship therewith and a binder, wherein the recording material further contains a non-halide-ion-containing arylonium compound exclusive of compounds according to formula (I):

(I)

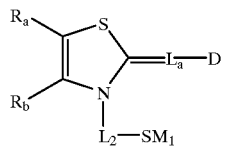

wherein $L_a$ is a valence bond or a divalent or trivalent linking group, $L_2$ is an alkylene group, each of $R_a$ and $R_b$ is a hydrogen atom or monovalent substituent group, $M_1$ is an onium ion, $R_a$ and $R_b$ may form a ring taken together and D is an electron donative group of atoms, with the proviso that where D is a hydrazino group which is not a part of a semicarbazido group, no oxo group is substituted to the carbon atom which is directly attached to a nitrogen atom of the hydrazine.

A recording process is also provided according to the present invention comprising the steps of: (i) bringing an outermost layer of the above described recording material in proximity with a heat source; and (ii) applying heat from the heat source imagewise to the recording material while maintaining proximity to the heat source to produce an image; and (iii) removing the recording material from the heat source.

Preferred embodiments of the invention are disclosed in the dependent claims.

DETAILED DESCRIPTION OF THE INVENTION

In a preferred embodiment of the recording process, according to the present invention, the heat source is a thermal head with a thin film thermal head being particularly preferred.

Substantially

By substantially light-insensitive is meant not intentionally light sensitive.

Non-Halide-Ion-Containing Arylonium Compounds

Halide ion containing onium compounds are excluded because they convert organic silver salts into photosensitive silver halide. The non-halide-ion-containing arylonium compound used in the recording material of the present invention is preferably selected from the group consisting of polyarylphosphonium compounds, substituted polyarylphosphonium compounds, mono-arylammonium compounds, substituted mono-arylammonium compounds, polyarylammonium compounds, substituted polyarylammonium compounds, diarylsulphonium compounds, substituted diarylsulphonium compounds, mono-arylsulphonium compounds, substituted mono-arylsulphonium compounds, heterocyclic phosphonium compounds, substituted heterocyclic phosphonium compounds, heterocyclic ammonium compounds and substituted heterocyclic ammonium compounds. By the term polyaryl is meant at least two aryl groups directly bonded to the nitrogen atom of the ammonium group or the phosphor atom of the phosphonium group. The remaining substituents of these onium compounds are either hydrogen, alkylgroups or substituted alkyl groups. By the terms heterocyclic ammonium compounds and heterocyclic phosphonium compounds is meant compounds with a quaternary nitrogen atom or a quaternary phosphonium atom in a heterocyclic ring, for example a pyridinium compound.

The use of triphenylphosphonium compounds and substituted triphenylphosphonium compounds in the recording materials according to the present invention is particularly preferred. Suitable compounds for use in the recording materials of the present invention are:

PC01=(2-methoxyethyl)triphenylphosphonium toluenesulphonate

PC02=ethyltriphenylphosphonium toluenesulphonate

PC03=(2-triphenylphosphonium) ethyltriphenylphosphonium benzenesulphonate

Thermosensitive Element

The thermosensitive element, according to the present invention, comprises an organic silver salt, an organic reducing agent therefor in thermal working relationship therewith and a binder. The element may comprise a layer system in which the ingredients may be dispersed in different layers, with the proviso that the two ingredients are in reactive association with one another i.e. during the thermal development process the reducing agent must be present in such a way that it is able to diffuse to the organic silver salt so that reduction of organic silver salt to silver can occur giving the desired image-tone.

In a preferred embodiment of the present invention the thermosensitive element further comprises a photosensitive species capable upon exposure of forming a species capable of catalyzing reduction of the organic silver salt.

Substantially Light-Insensitive Organic Silver Salts

Preferred substantially light-insensitive organic silver salts used in the present invention are silver salts of organic carboxylic acids and in particular silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". A preferred silver salt of an organic carboxylic acid is selected from the group consisting of silver behenate, silver stearate and silver palmitate.

Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the present invention.

Reducing Agents

Suitable organic reducing agents for the reduction of the substantially light-insensitive organic heavy metal salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly useful are polyhydroxy spiro-bis-indane compounds.

Among the catechol-type reducing agents, i.e. reducing agents containing at least one benzene nucleus with two hydroxy groups (—OH) in ortho-position, the following are preferred: catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents, are described in EP-B 692 733 and unpublished European Patent Application EP 97202872.4.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic heavy metal salt such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols such as described in the periodical Research Disclosure, February 1979, item 17842, in U.S. Pat. Nos. 4,360,581 and 4,782,004, and in EP-A 423 891. Other preferred auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Suitable dispersants are natural polymeric substances, synthetic polymeric substances and finely divided powders, for example finely divided non-metallic inorganic powders such as silica. Suitable hydrophilic natural or synthetic polymeric substances contain one or more hydroxyl, carboxyl or phosphate groups, e.g. protein-type binders such as gelatin, casein, collagen, albumin and modified gelatin; modified cellulose; starch; modified starch; modified sugars; modified dextrans etc. Examples of suitable hydrophilic synthetic polymeric substances are polyvinylalcohol; polyvinylpyrrolidone; polyacrylic acid; and polymethacrylic acid and their copolymers.

Polycarboxylic Acids and Anhydrides Thereof

According to the recording material of the present invention the thermosensitive element may comprise in addition at least one polycarboxylic acid and/or anhydride thereof in a molar percentage of at least 20 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g.: succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are: maleic acid, citraconic acid, itaconic acid and aconitic acid. Suitable polycarboxylic acids are citric acid and derivatives thereof, acetonedicarboxylic acid, iso-citric acid and α-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Film-Forming Binders of the Thermosensitive Element

The film-forming binder of the thermosensitive element containing the substantially light-insensitive organic heavy metal salt may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

A particularly suitable polyvinyl butyral containing a minor amount of vinyl alcohol units is marketed under the trade name BUTVAR™ B79 of Monsanto USA and provides a good adhesion to paper and properly subbed polyester supports.

The layer containing the organic silver salt is commonly coated onto a support in sheet- or web-form from an organic solvent containing the binder dissolved therein, but may also be applied from an aqueous medium containing a water-soluble binder and/or a water dispersible binder.

Suitable water-soluble film-forming binders for use in thermographic and photothermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives. A preferred water-soluble binder for use in the thermographic and photothermographic recording materials of the present invention is gelatin.

Suitable water-dispersible binders for use in the thermographic and photothermographic recording materials of the present invention may be any water-insoluble polymer e.g. water-insoluble cellulose derivatives, polyurethanes, polyesters polycarbonates and polymers derived from α,β-ethylenically unsaturated compounds such as after-chlorinated polyvinyl chloride, partially hydrolyzed polyvinyl acetate, polyvinyl alcohol, polyvinyl acetals preferably polyvinyl butyral, and homopolymers and copolymers produced using monomers selected from the group consisting of: vinyl chloride, vinylidene chloride, acrylonitrile, acrylamides, methacrylamides, methacrylates, acrylates, methacrylic acid, acrylic acid, vinyl esters, styrenes, dienes and alkenes; or mixtures thereof. It should be noted that there is no clear cut transition between a polymer dispersion and a polymer solution in the case of very small polymer particles resulting in the smallest particles of the polymer being dissolved and those slightly larger being in dispersion.

Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according the the present invention are water-dispersible film-forming polymers with covalently bonded moieties with one or more acid groups.

Water-dispersible binders with crosslinkable groups, e.g. epoxy groups, aceto-acetoxy groups and crosslinkable double bonds are also preferred.

Preferred water-dispersible binders for use in the thermographic and photothermographic recording materials of the present invention are polymer latexes.

Binder to Organic Silver Salt Ratio

The binder to organic silver salt weight ratio is preferably in the range of 0.2 to 6, and the thickness of the recording layer is preferably in the range of 5 to 50 $\mu$m.

Thermal Solvent

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agent

In order to obtain a neutral black image tone in the higher densities and neutral grey in the lower densities the recording layer contains preferably in admixture with the organic heavy metal salts and reducing agents a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB-P 1,439,478, U.S. Pat. No. 3,951,660 and U.S. Pat. No. 5,599,647. A toner compound particularly suited for use in combination with polyhydroxy benzene reducing agents is 3,4-dihydro-2,4-dioxo-1,3,2H-benzoxazine described in U.S. Pat. No. 3,951,660.

Other Additives

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE™ Öl A (from BAYER AG, GERMANY), ultraviolet light absorbing compounds, white light reflecting and/or ultraviolet radiation reflecting pigments and/or optical brightening agents.

Support

The support for the thermal imaging material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl and static.

Outermost Layer

The outermost layer of the recording material may in different embodiments of the present invention be the outermost layer of the thermosensitive element, a protective layer applied to the thermosensitive element or a layer on the opposite side of the support to the thermosensitive element.

Protective Layer

According to a preferred embodiment of the recording material, according to the present invention, the thermosensitive element is coated with a protective layer to avoid local deformation of the thermosensitive element and to improve resistance against abrasion.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative.

Water-Soluble or Water-Dispersible Binder for Outermost Layer

According to an embodiment of the present invention the outermost layer of the recording material may comprise a water-soluble binder, a water-dispersible binder or a mixture of a water-soluble and a water-soluble binder. Suitable water-soluble binders for the outermost layer are, for example, gelatin, polyvinylalcohol, cellulose derivatives or other polysaccharides, hydroxyethyl-cellulose, hydroxypropylcellulose etc., with hardenable binders being preferred and polyvinylalcohol being particularly preferred. Suitable water-dispersible binders are polymeric latexes.

Crosslinking Agents for Outermost Layer

The outermost layer according to the present invention may be crosslinked. Crosslinking can be achieved by using crosslinking agents such as described in WO 95/12495 for protective layers, e.g. tetra-alkoxysilanes, polyisocyanates, aldehydes, zirconates, titanates, melamine resins etc., with tetraalkoxysilanes such as tetramethylorthosilicate and tetraethylorthosilicate being preferred.

Matting Agents for Outermost Layer

The outermost layer of the recording material according to the present invention may comprise a matting agent. Suitable matting agents are described in WO 94/11198 and include e.g. talc particles and optionally protrude from the outermost layer.

Lubricants for Outermost Layer

Solid or liquid lubricants or combinations thereof are suitable for improving the slip characteristics of the recording materials according to the present invention.

Solid lubricants which can be used according to the present invention are polyolefin waxes, ester waxes, polyolefin-polyether block copolymers, amide waxes, polyglycols, fatty acids, fatty alcohols, natural waxes and solid phosphoric acid derivatives. Preferred solid lubricants are thermomeltable particles such as those described in WO 94/11199.

Liquid lubricants which can be used according to the present invention according to the present invention are fatty acid esters such as glycerine trioleate, sorbitan monooleate and sorbitan trioleate, silicone oil derivatives and phosphoric acid derivatives.

Photosensitive Species

A preferred photosensitive species capable upon exposure of forming species capable of catalyzing reduction of the silver behenate of the present invention is silver halide.

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitizers

The recording material, according to the present invention, may contain an infra-red sensitizer, an ultra-violet light sensitizer or a visible light sensitizer. Suitable sensitizers include cyanine, merocyanine, styryl, hemicyanine, oxonol, hemioxonol and xanthene dyes. Useful cyanine dyes include those having a basic nucleus, for example a thiazoline nucleus, an oxazoline nucleus, a pyrroline nucleus, a pyridine nucleus, an oxazole nucleus, a thiazole nucleus, a selenazole nucleus and an imidazole nucleus. Preferred merocyanine dyes include those having not only the above described basic nuclei but also acid nuclei, for example a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. Of the above described cyanine and merocyanine dyes, those having imino groups or carboxyl groups are particularly preferred.

Suitable infra-red sensitizers include those disclosed in EP-A's 465 078, 559 101, 616 014 and 635 756, JN's 03-080251, 03-163440, 05-019432, 05-072662 and 06-003763 and U.S. Pat. Nos. 4,515,888, 4,639,414, 4,713,316, 5,258,282 and 5,441,866.

Supersensitizers

According to the present invention the recording material may further includes a supersensitizer. Preferred supersensitzers are selected from the group of compounds consisting of: mercapto-compounds, disulfide-compounds, stilbene compounds, organoborate compounds and styryl compounds. Suitable supersensitizers for use with infra-red spectral sensitizers are disclosed in EP-A 559 228, EP-A 587 338, U.S. Pat. No. 3,877,943, U.S. Pat. No. 4,873,184 and unpublished European Patent Application EP 96202107.7.

Antihalation Dyes

The recording materials of the present invention may also contain antihalation or acutance dyes which absorb light which has passed through the photosensitive thermally developable photographic material, thereby preventing its reflection. Such dyes may be incorporated into the photosensitive thermally developable photographic material or in any other layer of the photographic material of the present invention.

Antistatic Layer

In a preferred embodiment the recording material of the present invention an antistatic layer is applied to the outermost layer not comprising at least one solid lubricant having a melting point below 150° C. and at least one liquid lubricant in a binder, wherein at least one of the lubricants is a phosphoric acid derivative.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power. The image-wise heating can be carried out such that heating elements not required to produce an image pixel generate an amount of heat ($H_e$) in accordance with the following formula:

$$0.5H_D<H_e<H_D$$

wherein $H_D$ represents the minimum amount of heat required to cause visible image formation in the thermographic recording material.

EP-A 654 355 describes a method for making an image by image-wise heating by means of a thermal head having energizable heating elements, wherein the activation of the heating elements is executed duty cycled pulsewise. When used in thermographic recording operating with thermal printheads the thermographic recording materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the thermographic recording material can also be carried out using an electrically resistive ribbon incorporated into the material. Image- or pattern-wise heating of the thermographic recording material may also proceed by means of pixel-wise modulated ultra-sound, using e.g. an ultrasonic pixel printer as described e.g. in U.S. Pat. No. 4,908,631.

Photothermographic Processing

Photothermographic recording materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Direct thermal imaging can be used for both the production of transparencies and reflection type prints. Application of the present invention is envisaged in the fields of both graphics images requiring high contrast images with a very steep print density applied dot energy dependence and continuous tone images requiring a weaker print density applied dot energy dependence, such as required in the medical diagnostic field. In the hard copy field recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims.

The invention is illustrated hereinafter by way of invention examples and comparative examples. The percentages and ratios given in these examples are by weight unless otherwise indicated. The ingredients used in the invention and comparative examples, other than those mentioned above, are:

as organic silver salt:

AgB=silver behenate;

as binders:

PVB=BUTVAR™ B79, a polyvinyl butyral from Monsanto;

as reducing agents:

R01=ethyl 3,4-dihydroxybenzoate;

as toning agents:

TA01=benzo[e][1,3]oxazine-2,4-dione;

TA02=7-(ethylcarbonato)-benzo[e][1,3]oxazine-2,4-dione (see formula II below)

(II)

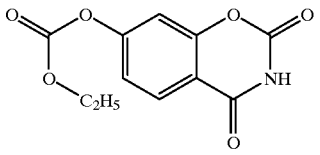

as levelling agent:

oil=Baysilone™, a silicone oil from Bayer AG;

as stabilizers:

S01=tetrachlorophthalic anhydride;

S02=adipic acid;

S03=benzotriazole.

INVENTION EXAMPLES 1 to 4 and COMPARATIVE EXAMPLE 1

Preparation of Silver Behenate

Silver behenate type I was prepared by dissolving the required quantity of behenic acid in 2-butanone at 60° C. with vigorous stirring followed by adding demineralized water while maintaining the reactor at a temperature of between 56 and 60° C., converting the behenic acid into sodium behenate, in the quantity and at the concentration specified in table 1, by adding an aqueous solution of sodium hydroxide with vigorous stirring while maintaining the temperature of the reactor at a temperature between 56 and 60° C. and finally converting the sodium behenate into silver behenate by adding the quantity of silver nitrate specified for the specific silver behenate type in table 1 as an aqueous solution, with the concentration specified for the specific silver behenate type in table 1, at the rate specified for the specific silver behenate type in table 1 with vigorous stirring while maintaining the reactor temperature at the temperature given for the specific silver behenate type in table 1. The final percentage by weight of 2-butanone in the suspending mixture of 2-butanone and water and the initial mixing number for the specific silver behenate type are also given in table 1.

TABLE 1

| | sodium behenate | | silver nitrate | | final % by | | $AgNO_3$ |
|---|---|---|---|---|---|---|---|
| AgB type | quantity [moles] | concentration* [M] | quantity [moles] | concentration [M] | weight 2-butanone | temperature [° C.] | addition time [min] |
| I | 180 | 0.248 | 180 | 0.4 | 23 | 65 | 240 |

*initial concentration

Dispersions of Silver Behenate in 2-Butanone

The silver behenate dispersion used in COMPARATIVE EXAMPLE 1 and INVENTION EXAMPLES 1 to 4 was obtained by ball milling for 120 hours 56.5 g of the dried silver behenate powder in a solution of 56.5 g of PVB in 387.5 g of 2-butanone.

Coating of Recording Materials

A subbed polyethylene terephthalate support having a thickness of 175 μm was doctor blade-coated from a coating composition containing 2-butanone as a solvent using the above-described silver behenate dispersions and the additional ingredients given below so as to obtain thereon, after drying for 1 hour at 50° C., layers with the compositions given in Table 2 for the thermographic recording materials of COMPARATIVE EXAMPLE 1 and INVENTION EXAMPLES 1 to 4.

TABLE 2

| | AgB [g/m²] | PVB [g/m²] | R01 [g/m²] | PC01 mol % vs AgB | PC01 [g/m²] | TA01 [g/m²] | TA02 [g/m²] | Oil [g/m²] | S01 [g/m²] | S02 [g/m²] | S03 [g/m²] |
|---|---|---|---|---|---|---|---|---|---|---|---|
| Comparative example nr | | | | | | | | | | | |
| 1 | 4.40 | 17.6 | 0.90 | 0 | 0 | 0.27 | 0.14 | 0.040 | 0.14 | 0.32 | 0.12 |
| Invention example nr | | | | | | | | | | | |
| 1 | 4.40 | 17.6 | 0.90 | 2 | 0.10 | 0.27 | 0.14 | 0.040 | 0.14 | 0.32 | 0.12 |
| 2 | 4.40 | 17.6 | 0.90 | 4 | 0.19 | 0.27 | 0.14 | 0.040 | 0.14 | 0.32 | 0.12 |
| 3 | 4.40 | 17.6 | 0.90 | 6 | 0.29 | 0.27 | 0.14 | 0.040 | 0.14 | 0.32 | 0.12 |
| 4 | 4.31 | 17.2 | 0.88 | 8 | 0.38 | 0.26 | 0.13 | 0.039 | 0.14 | 0.31 | 0.11 |

Thermographic Printing the printer was equipped with a thin film thermal head with a resolution of 300 dpi and was operated with a line time of 19 ms (the line time being the time needed for printing one line). During the line time the print head received constant power. The average printing power, being the total amount of electrical input energy during one line time divided by the line time and by the surface area of the heat-generating resistors was 1.6 mJ/dot being sufficient to obtain maximum optical density in each of the recording materials. During printing the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving the ribbon with a total thickness of 6 μm.

Image Evaluation the optical maximum and minimum densities of the prints obtained with the recording materials of COMPARATIVE EXAMPLE 1 and INVENTION EXAMPLES 1 to 4 measured through a visual filter (vis) with a Macbeth™ TR924 densitometer for grey scale steps corresponding to data levels of 255 and 0 respectively are given in table 3.

Image Tone Assessment

The image tone was determined by first printing recording materials as described above and then subjecting the prints to visual inspection and to measurement of the b* CIELAB-value of the image as a function of image density as determined with a MACBETH™ TR924 densitometer. The L*, a* and b* CIELAB-values were determined by spectrophotometric measurements according to ASTM Norm E179-90 in a R(45/0) geometry with evaluation according to ASTM Norm E308-90. Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive. The visually assessed image tone and the b* value at an optical density of 2.0 measured using the visual filter for the recording materials of COMPARATIVE EXAMPLE 1 and INVENTION EXAMPLE 1 to 4 are summarized in table 4.

Image Gradation Assessment

Image gradation was assessed using a numerical gradation value (NGV) defined by the expression: $(D_{1.6}-D_{0.96})/(1.6-0.96)$ where $D_{1.6}$ is the optical density as measured through a visual filter obtained upon the application of 1.6 millijoules to a dot of area 87 μm×87 μm of the recording layer and $D_{0.96}$ is the optical density as measured through a visual filter obtained upon the application of 0.96 millijoules to a dot of area 87 μm×87 μm of the recording layer. The applied energy in Joules is the electrical energy actually applied to each resistor of the thermal head.

The NGV-values obtained for fresh prints of the recording materials of COMPARATIVE EXAMPLE 1 and INVENTION EXAMPLES 1 to 4 are also given in table 3.

TABLE 3

| | mol % PC01 vs AgB | print characteristics $D_{max}$ (vis) | $D_{min}$ (vis) | NGV-value | image tone from visual inspection | b* for D = 2.0 |
|---|---|---|---|---|---|---|
| Comparative example number | | | | | | |
| 1 | 0 | 2.95 | 0.06 | 3.47 | brown | +0.5 |
| Invention example number | | | | | | |
| 1 | 2 | 3.22 | 0.06 | 3.78 | brown | +0.6 |
| 2 | 4 | 3.20 | 0.06 | 3.86 | brown | +0.85 |
| 3 | 6 | 3.21 | 0.06 | 3.83 | brown | +0.7 |
| 4 | 8 | 3.33 | 0.06 | 3.84 | brown | +0.8 |

The results of table 3 for thermographic recording materials of INVENTION EXAMPLES 1 to 4 with the phosphonium compound PC01 in different concentrations show comparable b*-values with that for COMPARATIVE EXAMPLE 1, indicating little change in image tone, but considerable improvements in both the maximum optical density and in gradation, as indicated by the increased NGV-values.

INVENTION EXAMPLES 5 to 7 and COMPARATIVE EXAMPLE 2

The silver behenate powder type II used in the preparation of the thermographic materials of COMPARATIVE EXAMPLE 2 and INVENTION EXAMPLES 5 to 7 were prepared as described for the silver behenate powder used in the preparation of the thermographic materials of COMPARATIVE EXAMPLE 1 and INVENTION EXAMPLES 1 to 4 except that the conditions given in table 4 were used instead of those in table 1.

TABLE 4

| AgB type | sodium behenate quantity [moles] | sodium behenate concentration* [M] | silver nitrate quantity [moles] | silver nitrate concentration [M] | final % by weight 2-butanone | temperature [° C.] | $AgNO_3$ addition time [min] | initial mixing number $MN_0$ |
|---|---|---|---|---|---|---|---|---|
| II | 110.9 | 0.100 | 110.9 | 1.67 | 45 | 55 | $3^+$ + $15^x$ | $5.29 \times 10^{-3}$ |

*initial concentration
+ first half of AgNO
x second half of $AgNO_3$

The silver behenate dispersion used in COMPARATIVE EXAMPLE 2 and INVENTION EXAMPLES 5 to 7 was obtained by first preparing a predispersion by adding 56.5 g of the dried silver behenate powder type II to a solution of 56.5 g of PVa in 413.1 g of 2-butanone and then stirring for 10 minutes with an Ultra-Turrax™ stirrer. This predispersion was then microfluidized by passing it once through a MICROFLUIDICS™ M-110Y high pressure microfluidizer at a jet pressure of 400 bar to produce a 10.74% by weight dispersion of silver behenate in 2-butanone.

Coating of Recording Materials

A subbed polyethylene terephthalate support having a thickness of 175 μm was doctor blade-coated from a coating composition containing 2-butanone as a solvent using the above-described silver behenate dispersion and the additional ingredients given below so as to obtain thereon, after drying for 1 hour at 50° C., layers with the compositions given in Table 5 for the thermographic recording materials of COMPARATIVE EXAMPLE 2 and INVENTION EXAMPLES 5 to 7.

TABLE 5

| | AgB | PVB | R01 | Phsophonium compound | | TA01 | TA02 | Oil | S01 | S02 | S03 |
|---|---|---|---|---|---|---|---|---|---|---|---|
| | [g/m²] | [g/m²] | [g/m²] | type | [g/m²] | [g/m²] | [g/m²] | [g/m²] | [g/m²] | [g/m²] | [g/m²] |
| Comparative example nr | | | | | | | | | | | |
| 2 | 4.85 | 19.4 | 0.99 | — | — | 0.29 | 0.15 | 0.044 | 0.08 | 0.35 | 0.13 |
| Invention example nr | | | | | | | | | | | |
| 5 | 4.56 | 18.3 | 0.93 | PC01 | 0.40 | 0.28 | 0.14 | 0.041 | 0.07 | 0.33 | 0.12 |
| 6 | 4.60 | 18.4 | 0.94 | PC02 | 0.38 | 0.28 | 0.14 | 0.041 | 0.07 | 0.33 | 0.12 |
| 7 | 4.69 | 18.8 | 0.96 | PC03 | 0.73 | 0.28 | 0.15 | 0.042 | 0.08 | 0.34 | 0.12 |

Thermographic printing with the thermographic recording materials of COMPARATIVE EXAMPLE 2 and INVENTION EXAMPLES 5 to 7 and the evaluation thereof were carried out as described for the thermographic recording materials of COMPARATIVE EXAMPLE 1 and INVENTION EXAMPLES 1 to 4. The evaluation results are summarized in Table 6 for the image tone.

TABLE 6

| | phosphonium compound | print characteristics | | | | |
|---|---|---|---|---|---|---|
| | | $D_{max}$ (vis) | $D_{min}$ (vis) | NGV-value | image tone from visual inspection | b* for D = 2.0 |
| Comparative example number | | | | | | |
| 2 | — | 2.85 | 0.08 | 3.27 | blue | −3.4 |
| Invention example number | | | | | | |
| 5 | PC01 | 2.84 | 0.07 | 3.42 | blue-red | −1.2 |
| 6 | PC02 | 3.10 | 0.06 | 3.72 | blue-red | −0.6 |
| 7 | PC03 | 3.26 | 0.06 | 3.95 | neutral | 0.0 |

The prints produced with the recording materials of INVENTION EXAMPLES 5 to 6 exhibit more neutral b*-values than the recording material of Comparative EXAMPLE 2, but comparable or increased maximum optical density values and strongly increased image gradations, as indicated by the increased NGV-values.

INVENTION EXAMPLES 8 to 10 and COMPARATIVE EXAMPLE 3

The silver behenate powder type III used in the preparation of the thermographic materials of COMPARATIVE EXAMPLE 3 and INVENTION EXAMPLES 8 to 10 were prepared as described for the silver behenate powder used in the preparation of the thermographic materials of COMPARATIVE EXAMPLE 2 and INVENTION EXAMPLES 5 to 7 except that the conditions given in table 7 were used instead of those in table 4.

TABLE 7

| | sodium behenate | | silver nitrate | | final % by | | $AgNO_3$ |
|---|---|---|---|---|---|---|---|
| AgB type | quantity [moles] | concentration* [M] | quantity [moles] | concentration [M] | weight 2-butanone | temperature [° C.] | addition time [min] |
| III | 151.4 | 0.194 | 151.4 | 5.91 | 40.9 | 55 | 2.5 |

*initial concentration

A silver behenate dispersion was prepared with silver behenate powder type III by first preparing a predispersion by adding 56.5 g of the dried silver behenate powder type III to a solution of 56.5 g of PVB in 389.2 g of 2-butanone and stirring for 10 minutes with an Ultra-Turrax™ stirrer. This predispersion was then microfluidized by passing it once through a MICROFLUIDICS™ M-110Y high pressure microfluidizer at a jet pressure of 400 bar to produce a 11.25% by weight dispersion of silver behenate in 2-butanone.

A subbed polyethylene terephthalate support having a thickness of 175 μm was doctor blade-coated from a coating composition containing 2-butanone as a solvent using the above-described silver behenate dispersions and the additional ingredients given below so as to obtain thereon, after drying for 1 hour at 50° C., layers with the compositions given in Table 8 for the thermographic recording materials of COMPARATIVE EXAMPLE 3 and INVENTION EXAMPLES 8 to 10.

TABLE 8

| | AgB [g/m²] | PVB [g/m²] | R01 [g/m²] | PC01 mol % vs AgB | PC01 [g/m²] | TA01 [g/m²] | TA02 [g/m²] | Oil [g/m²] | S01 [g/m²] | S02 [g/m²] | S03 [g/m²] |
|---|---|---|---|---|---|---|---|---|---|---|---|
| Comparative example nr | | | | | | | | | | | |
| 3 | 3.90 | 15.6 | 0.79 | 0 | 0 | 0.24 | 0.12 | 0.035 | 0.062 | 0.28 | 0.10 |
| Invention example nr | | | | | | | | | | | |
| 8 | 3.90 | 15.6 | 0.79 | 4 | 0.17 | 0.24 | 0.12 | 0.035 | 0.062 | 0.28 | 0.10 |
| 9 | 3.94 | 15.8 | 0.80 | 6 | 0.26 | 0.24 | 0.12 | 0.035 | 0.063 | 0.28 | 0.10 |
| 10 | 4.27 | 17.1 | 0.87 | 8 | 0.38 | 0.26 | 0.13 | 0.038 | 0.068 | 0.31 | 0.11 |

Thermographic printing with the thermographic recording materials of COMPARATIVE EXAMPLE 3 and INVENTION EXAMPLES 8 to 10 and the evaluation thereof were carried out as described for the thermographic recording materials of COMPARATIVE EXAMPLE 1 and INVENTION EXAMPLES 1 to 4. The evaluation results are summarized in Table 9 for the image tone.

TABLE 9

| | mol % PC01 vs AgB | print characteristics $D_{max}$ (vis) | $D_{min}$ (vis) | NGV-value | image tone from visual inspection | b* for D = 2.0 |
|---|---|---|---|---|---|---|
| Comparative example number | | | | | | |
| 3 | 0 | 2.50 | 0.06 | 2.84 | blue | −5.0 |
| Invention example number | | | | | | |
| 8 | 4 | 2.66 | 0.07 | 3.09 | blue | −4.25 |
| 9 | 6 | 2.65 | 0.07 | 3.08 | blue | −4.7 |
| 10 | 8 | 2.94 | 0.07 | 3.38 | blue | −3.7 |

The results of table 9 for thermographic recording materials of INVENTION EXAMPLES 8 to 10 with the phosphonium compound PC01 in different concentrations show comparable b*-values, indicating little change in image tone, compared with that of COMPARATIVE EXAMPLE 3, but increased maximum image densities and increased image gradation, as indicated by the increased NGV-values.

Having described in detail preferred embodiments of the current invention, it will now be apparent to those skilled in the art that numerous modifications can be made therein without departing from the scope of the invention as defined in the following claims.

We claim:

1. A substantially light-insensitive recording material exclusive of a thermal bleachable dye comprising a support and a thermosensitive element comprising an organic silver salt, an organic reducing agent therefor in thermal relationship therewith and a binder, wherein said recording material further contains a non-halide-containing arylonium compound selected from the group consisting of polyarylphosphonium compounds, substituted polyarylphosphonium compounds, mono-arylammonium compounds, substituted mono-arylammonium compounds, polyarylammonium compounds, substituted polyarylammonium compounds, diarylsulphonium compounds, substituted diarylsulphonium compounds, mono-arylsulphonium compounds, substituted mono-arylsulphonium compounds, heterocyclic phosphonium compounds, substituted heterocyclic phosphonium compounds, heterocyclic ammonium compounds, and substituted heterocyclic ammonium compounds.

2. Recording material according to claim 1, wherein said organic silver salt is a silver salt of an organic carboxylic acid.

3. Recording material according to claim 2, wherein said silver salt of an organic carboxylic acid is selected from the group consisting of silver behenate, silver stearate and silver palmitate.

4. Recording material according to claim 1, wherein said thermosensitive element further contains a toning agent.

5. Recording material according to claim 1, wherein said thermosensitive element is provided with a protective layer.

6. Recording material according to claim 1, wherein said non-halide-ion-containing arylonium compound contains an arylsulfonate anion.

7. A recording material exclusive of a thermal bleachable dye comprising a support and a thermosensitive element comprising an organic silver salt, an organic reducing agent therefor in thermal working relationship therewith and a binder, wherein said recording material further contains a substituted or unsubstituted triphenylphosphonium compound.

8. Recording material according to claim 7, wherein said substituted or unsubstituted triphenylphosphonium compound is selected from the group consisting of: (2-methoxyethyl)-triphenylphosphonium toluenesulphonate, ethyltriphenyl-phosphonium toluenesulphonate, and (2-triphenylphosphonium) ethyltriphenylphosphonium benzenesulphonate.

9. A substantially light-insensitive recording material exclusive of a thermal bleachable dye comprising a support and a thermosensitive element comprising a photosensitive silver halide, an organic silver salt, an organic reducing agent therefor in thermal working relationship therewith and a binder, wherein said recording material further contains a non-halide-ion-containing arylonium compound selected from the group consisting of polyarylphosphonium compounds, substituted polyarylphosphonium compounds, mono-arylammonium compounds, substituted mono-arylammonium compounds, polyarylammonium compounds, substituted polyarylammonium compounds, diarylsulphonium compounds, substituted diarylsulphonium compounds, mono-arylsulphonium compounds, substituted mono-arylsulphonium compounds, heterocyclic phosphonium compounds, substituted heterocyclic phosphonium compounds, heterocyclic ammonium compounds, and substituted heterocyclic ammonium compounds.

10. A substantially light-insensitive recording process comprising the steps of: (i) bringing an outermost layer of a recording material exclusive of a thermal bleachable dye having a support and a thermosensitive element comprising an organic silver salt, an organic reducing agent therefor in thermal working relationship therewith and a binder; in proximity with a heat source and (ii) applying heat from said heat source imagewise to said recording material while maintaining proximity to said heat source to produce an image; and (iii) removing said recording material from said heat source; wherein said recording material further contains a non-halide-ion-containing arylonium compound selected from the group consisting of polyarylphosphonium compounds, substituted polyarylphosphonium compounds, mono-ayrlammonium compounds, substituted mono-arylammonium compounds, polyarylammonium compounds, substituted polyarylammonium compounds, diarylsulphonium compounds, substituted diarylsulphonium compounds, mono-arylsulphonium compounds, substituted mono-arylsulphonium compounds, heterocyclic phosphonium compounds, substituted heterocyclic phosphonium compounds, heterocyclic ammonium compounds, and substituted heterocyclic ammonium compounds.

11. A recording process according to claim 9, wherein said heat source is a thin film thermal head.

12. A recording process comprising the steps of: (i) bringing an outermost layer of a recording material exclusive of a thermal bleachable dye having a support and a thermosensitive element comprising a photosensitive silver halide, an organic silver salt, an organic reducing agent therefor in thermal working relationship therewith and a binder, in proximity with a light source; (ii) image-wise exposing said recording material; and (iii) uniformly heating said image-wise exposed recording material; wherein said recording material further contains a non-halide-ion-containing arylonium compound selected from the group consisting of polyarylphosphonium compounds, substituted polyarylphosphonium compounds, mono-arylammonium compounds, substituted mono-arylammonium compounds, polyarylammonium compounds, substituted polyarylammonium compounds, diarylsulphonium compounds, substituted diarylsulphonium compounds, mono-arylsulphonium compounds, substituted mono-arylsulphonium compounds, heterocyclic phosphonium compounds, substituted heterocyclic phosphonium compounds, heterocyclic ammonium compounds, and substituted heterocyclic ammonium compounds.

* * * * *

UNITED STATES PATENT AND TRADEMARK OFFICE

CERTIFICATE OF CORRECTION

PATENT NO. : 6,037,114
APPLICATION NO. : 09/199924
DATED : March 14, 2000
INVENTOR(S) : Hoogmartens et al.

It is certified that error appears in the above-identified patent and that said Letters Patent is hereby corrected as shown below:

Column 16, line 67, "PVa" should read -- PVB --;

Column 22, line 11, "claim 9," should read -- claim 10, --.

Signed and Sealed this

Seventeenth Day of July, 2007

JON W. DUDAS
*Director of the United States Patent and Trademark Office*